US007646995B2

(12) United States Patent
Kim et al.

(10) Patent No.: US 7,646,995 B2
(45) Date of Patent: Jan. 12, 2010

(54) WASTE TONER TRANSFER DEVICE, WASTE TONER CLEANING DEVICE HAVING THE WASTE TONER TRANSFER DEVICE, DEVELOPING UNIT HAVING THE WASTE TONER CLEANING DEVICE, AND IMAGE FORMING APPARATUS

(75) Inventors: Jong-in Kim, Suwon-si (KR); Myoung-su Baek, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 120 days.

(21) Appl. No.: 11/873,662

(22) Filed: Oct. 17, 2007

(65) Prior Publication Data

US 2008/0226367 A1 Sep. 18, 2008

(30) Foreign Application Priority Data

Mar. 12, 2007 (KR) ..... 10-2007-0024127

(51) Int. Cl.
*G03G 21/00* (2006.01)
*G03G 21/12* (2006.01)

(52) U.S. Cl. ..... 399/35; 399/343; 399/349; 399/350; 399/358

(58) Field of Classification Search ..... 399/35, 399/358, 360, 343, 349, 350
See application file for complete search history.

(56) References Cited

U.S. PATENT DOCUMENTS

| | | | | |
|---|---|---|---|---|
| 6,622,001 | B2 * | 9/2003 | Arimitsu et al. | 399/358 |
| 2006/0078361 | A1 * | 4/2006 | Park | 399/359 |
| 2006/0159497 | A1 * | 7/2006 | Choi et al. | 399/358 |
| 2007/0110458 | A1 * | 5/2007 | Inoue et al. | 399/35 |
| 2007/0147859 | A1 | 6/2007 | Adachi et al. | |

FOREIGN PATENT DOCUMENTS

| | | | |
|---|---|---|---|
| JP | 10301460 A | * | 11/1998 |
| JP | 2005-283626 | | 10/2005 |
| KR | 20060084466 | | 7/2006 |

OTHER PUBLICATIONS

European Search Report dated Jun. 23, 2008 in EP 08152505.7.
Office Action issued Mar. 20, 2009 in Korean Application No. 2007-0024127.

* cited by examiner

*Primary Examiner*—David M Gray
*Assistant Examiner*—G. M. Hyder
(74) *Attorney, Agent, or Firm*—Stanzione & Kim LLP

(57) ABSTRACT

A waste toner transfer device of an image forming apparatus includes a waste toner transfer unit which is disposed in proximity to a cleaning member to transfer waste toner removed from a photoconductive medium by the cleaning member, and includes a plurality of protrusions at one end, a driving unit which horizontally reciprocates the waste toner transfer unit, and a plurality of ribs which constrain the plurality of protrusions when the waste toner transfer unit moves, so that the waste toner transfer unit vibrates vertically.

26 Claims, 5 Drawing Sheets

WASTE TONER TRANSFER DEVICE, WASTE TONER CLEANING DEVICE HAVING THE WASTE TONER TRANSFER DEVICE, DEVELOPING UNIT HAVING THE WASTE TONER CLEANING DEVICE, AND IMAGE FORMING APPARATUS

CROSS-REFERENCE TO RELATED APPLICATIONS

This application claims priority under 35 U.S.C. § 119(a) of Korean Patent Application No. 10-2007-0024127, filed in the Korean Intellectual Property Office on Mar. 12, 2007, the entire disclosure of which is incorporated herein by reference.

BACKGROUND OF THE INVENTION

1. Field of the Invention

The present general inventive concept relates to an image forming apparatus, and more particularly, to a waste toner transfer device, a waste toner cleaning device having the waste toner transfer device, and a developing unit having the waste toner cleaning device.

2. Description of the Related Art

In general, an electrophotographic image forming apparatus has a photoconductive medium cleaning unit to remove waste toner residue from a photoconductive medium.

The photoconductive medium cleaning unit includes a scraper to physically scrape toner off of the surface of the photoconductive medium, and a waste toner collecting portion to collect waste toner scraped off of the photoconductive medium surface by the scraper. The waste toner collecting portion has a waste toner transfer device to convey waste toner without generating toner lumps.

The waste toner transfer device includes a waste toner conveyance, and a cam driving unit to shake the waste toner conveyance. The waste toner conveyance has a plurality of passing holes to break up lumps of waste toner. The cam driving unit shakes waste toner conveyance, preventing waste toner from being lumped on the waste toner conveyance.

The waste conveyance is usually reciprocated in a direction perpendicular to the direction of waste toner. Accordingly, the waste toner conveyance functions to prevent waste toner from lumping on the waste toner conveyance or to break up lumped waste toner, rather than functioning to transfer waste toner to the waste toner collecting portion.

In the above described method, the scraped waste toner is transferred passively to the waste toner collecting portion as it is moved on the waste toner conveyance. Therefore, if a large amount of waste toner is generated on the surface of the photoconductive medium due to malfunction of the image forming apparatus based on printing errors, such as an inferior transfer or a paper jam, the waste toner is not transferred to the waste toner unit rapidly enough and as a result flows backward toward the scraper.

SUMMARY OF THE INVENTION

The present general inventive concept provides a waste toner transfer device, a waste toner cleaning device having the waste toner transfer device, a transfer unit having the waste cleaning unit, and an image forming apparatus, which has the improved configuration to prevent the overflow of scraped waste toner when excessive waste toner is suddenly generated.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a waste toner transfer device, including a waste toner transfer unit which is disposed in proximity to a cleaning member to transfer waste toner removed from a rotatable photoconductive medium by the cleaning member, and includes a plurality of protrusions at one end, a driving unit to reciprocate the waste toner transfer unit along a first direction of motion, and a vibration generating unit to vibrate the waste toner transfer unit along a second direction of motion when the waste toner transfer unit moves along the first direction of motion.

The vibration generating unit includes a plurality of ribs to constrain the plurality of protrusions when the waste toner transfer unit moves in the first direction of motion.

The plurality of protrusions are bent upwards at a first end of the waste toner transfer unit to face the photoconductive medium.

The waste toner transfer unit includes a plurality of passing holes, and a guide slit to guide the waste toner transfer unit in rightward or leftward directions along the first direction of motion.

The waste toner transfer unit is formed of an elastic material.

The plurality of ribs are disposed on a waste toner housing to support the photoconductive medium.

The driving unit includes a delivery guide which is fixed at one end of the waste toner transfer unit and includes a cam follower, and a driving cam which has an inclined surface corresponding to the cam follower of the delivery guide.

The waste toner transfer unit is inclined downwards from a part of the waste toner transfer unit in close proximity to the photoconductive medium to a part opposite the photoconductive medium.

The waste toner housing includes an upper waste toner housing and a lower waste toner housing, and the waste toner transfer unit is interposed between a first constraining member and a second constraining member which are complementarily disposed on the upper waste toner housing and the lower waste toner housing, respectively.

The first constraining member is formed on the upper waste toner housing and the second constraining member is formed on the lower waste toner housing.

The second constraining member includes a first boss which passes through the guide slit, and a second boss to support the waste toner transfer unit under the guide slit.

The first boss has a diameter smaller than the guide slit, and the second boss has a diameter larger than the guide slit.

The second boss includes an inclining rib to inclinedly support the waste toner transfer unit.

The foregoing and/or other aspects and utilities of the present general inventive concept may be achieved by providing a waste toner cleaning device, including a cleaning member which removes waste toner from a photoconductive medium, a waste toner transfer unit which is disposed on a waste toner transfer surface of the cleaning member to receive the waste toner removed from the photoconductive medium by the cleaning member and to transfer the waste toner, and includes a plurality of protrusions at one end, a driving unit to reciprocate the waste toner transfer unit along a first direction of motion, a vibration generating unit to vibrate the waste toner transfer unit along a second direction of motion when the waste toner transfer unit moves along the first direction of motion, and a waste toner housing to store the waste toner transferred by the waste toner transfer unit.

The vibration generating unit includes a plurality of ribs to constrain the plurality of protrusions when the waste toner transfer unit moves along the first direction of motion.

The plurality of protrusions are bent to face the photoconductive medium.

The foregoing and/or other aspects and utilities of the present general inventive concept may be achieved by providing an image forming apparatus, including a photoconductive medium which is rotatably disposed in a housing to form an electrostatic latent image, a developing unit to develop the formed electrostatic latent image, and a waste toner cleaning device to remove waste toner from the photoconductive medium after the image is formed, wherein the waste toner cleaning device includes a cleaning member which faces the photoconductive medium to remove waste toner from the photoconductive medium, a waste toner transfer unit which is disposed on a waste toner transfer surface of the cleaning member to receive the waste toner removed from the photoconductive medium by the cleaning member and to transfer the waste toner, and includes a plurality of protrusions at one end, a driving unit to reciprocate the waste toner transfer unit along a first direction of motion, a vibration generating unit to vibrate the waste toner transfer unit along a second direction of motion when the waste toner transfer unit moves along the first direction of motion, and a waste toner housing to store the waste toner transferred by the waste toner transfer unit.

The vibration generating unit includes a plurality of ribs to constrain the plurality of protrusions when the waste toner transfer unit moves in the first direction.

The plurality of protrusions are bent toward the end facing the photoconductive medium.

The foregoing and/or other aspects and utilities of the present general inventive concept may be achieved by providing an image forming apparatus, including a photoconductive medium to form an electrostatic latent image, a developing unit to develop the formed electrostatic latent image of the photoconductive medium using toner, a transfer unit to transfer the developed image of the photoconductive medium onto printing paper, and a waste toner cleaning device to remove waste toner from the photoconductive medium, wherein the waste toner cleaning device includes a cleaning member of which one end contacts the photoconductive medium, a waste toner transfer unit which is disposed above and in proximity to the cleaning member to receive the waste toner removed from the photoconductive medium by the cleaning member and to transfer the waste toner, and the waste toner transfer unit vibrates horizontally and vertically, and a waste toner housing to store the waste toner transferred by the waste toner transfer unit.

The waste toner transfer unit includes a plurality of protrusions which are bent upwards at one end of the waste toner transfer unit to face the photoconductive medium, a plurality of ribs are disposed at a location of the waste toner housing facing the protrusions so that the waste toner transfer unit vibrates upward and downward by interference between the protrusions and the ribs.

The foregoing and/or other aspects and utilities of the present general inventive concept may be achieved by providing a waste toner transfer unit of an image forming apparatus, the waste toner transfer unit including a plate which is disposed to be movable vertically and horizontally inside a waste toner housing in order to break up and transfer waste toner removed from a surface of a photoconductive medium, and a plurality of protrusions which are bent upwards at one end of the plate to face the photoconductive medium, and to constrain at least one rib on the waste toner housing when the plate moves horizontally, so that the plate moves vertically.

The foregoing and/or other aspects and utilities of the present general inventive concept may be achieved by providing a waste toner transfer device including a waste toner transfer unit which is disposed in proximity to a cleaning member to transfer waste toner removed from a photoconductive medium by the cleaning member, and includes a plurality of protrusions which are bent upwards at one end.

The waste toner transfer unit may move in a predetermined direction.

The waste toner transfer unit may move along a first direction and a second direction of motion.

The foregoing and/or other aspects and utilities of the present general inventive concept may be achieved by providing a developing unit including a waste toner transfer device which includes a waste toner transfer unit which is disposed in proximity to a cleaning member to transfer waste toner removed from a photoconductive medium by the cleaning member, wherein the waste toner transfer unit includes a plurality of protrusions which are bent upwards at one end and moves in a predetermined direction.

The foregoing and/or other aspects and utilities of the present general inventive concept may be achieved by providing an image forming apparatus including a developing unit which includes a waste toner transfer device including a waste toner transfer unit which is disposed in proximity to a cleaning member to transfer waste toner removed from a photoconductive medium by the cleaning member, wherein the waste toner transfer unit includes a plurality of protrusions which are bent upwards at one end and moves along a first direction of motion and a second direction of motion.

The foregoing and/or other aspects and utilities of the present general inventive concept may be achieved by providing a method of removing waste toner in an image forming apparatus, including removing waste toner from a photoconductive medium, transferring the removed waste toner by a waste toner transfer unit to a waste toner housing, wherein the waste toner transfer unit is vibrated along a first direction of motion and along a second direction of motion to transfer the waste toner from the waste toner transfer unit to the waste toner housing.

The method of removing waste toner wherein the first direction of motion and the second direction of motion are substantially perpendicular to each other.

The method of removing waste toner wherein movement of the waste toner transfer unit in at least the first direction of motion is substantially of a sine wave pattern.

The method of removing waste toner wherein movement of the waste toner transfer unit in the first direction of motion and the second direction of motion is substantially of a sine wave pattern for each direction of motion.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
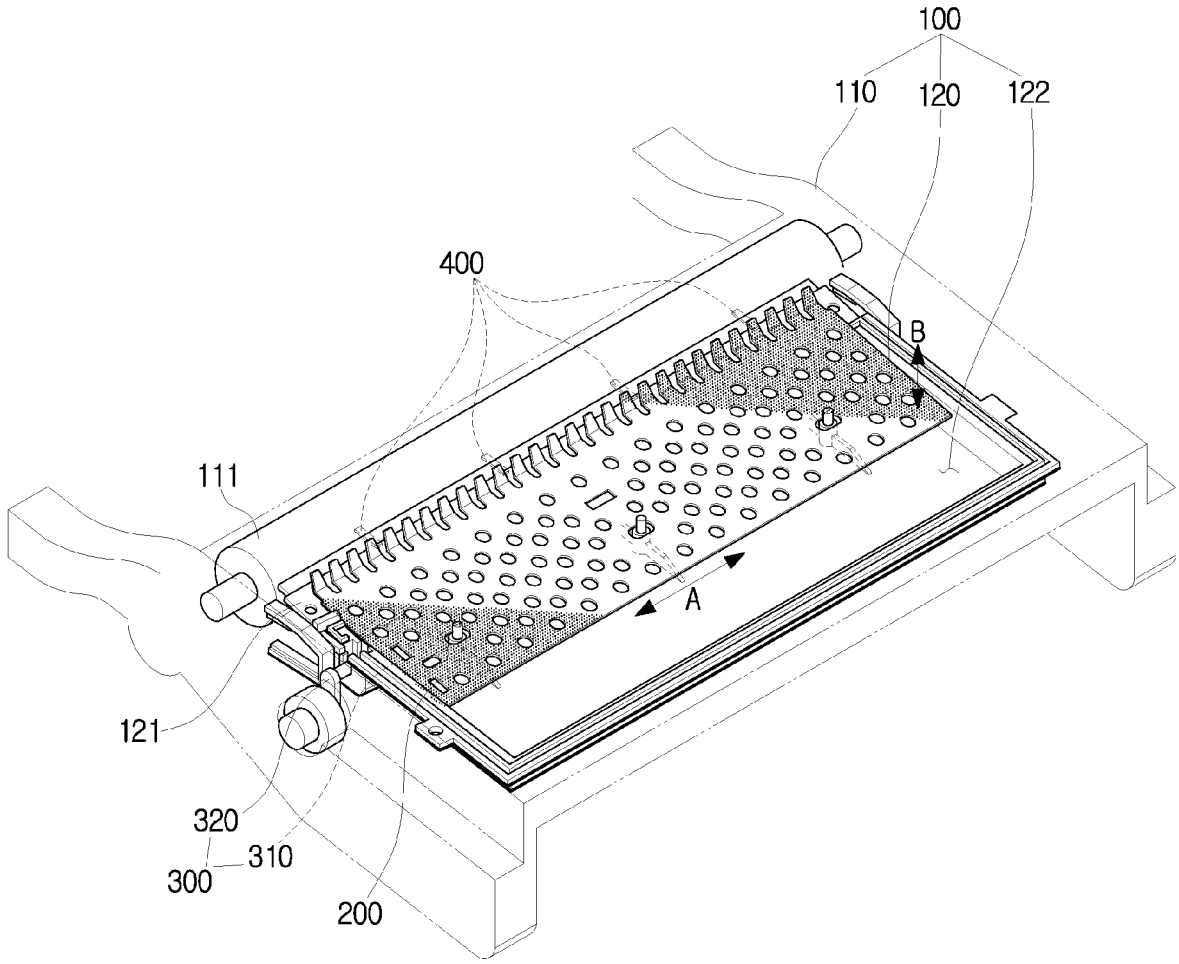
FIG. 1 is a perspective view schematically illustrating a waste toner transfer unit mounted on a developing unit of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As shown in FIG. 1, a waste toner transfer device of an image forming apparatus according to an embodiment of the present general inventive concept includes a waste toner transfer unit 200, a driving unit 300 and a plurality of ribs 400.

The waste toner transfer unit 200 is disposed above, and in proximity to, a cleaning member 121 so that waste toner, when scraped by the cleaning member 121, is transferred along the waste transfer member 200.

The cleaning member 121 is disposed inside a waste toner housing 100 which also has a waste toner collecting portion 122 therein, to remove waste toner residue from a photoconductive medium 111. The waste toner housing 100 includes an upper waste toner housing 110 and a lower waste toner housing 120. The photoconductive medium 111 is rotatably disposed at the upper waste toner housing 110, and the cleaning member 121 is disposed at the lower waste toner housing 120. The waste toner collecting portion 122 is disposed in a space formed by connecting the upper waste toner housing 110 to the lower waste toner housing 120, and collects waste toner scraped by the cleaning member 121.

Figure 2:
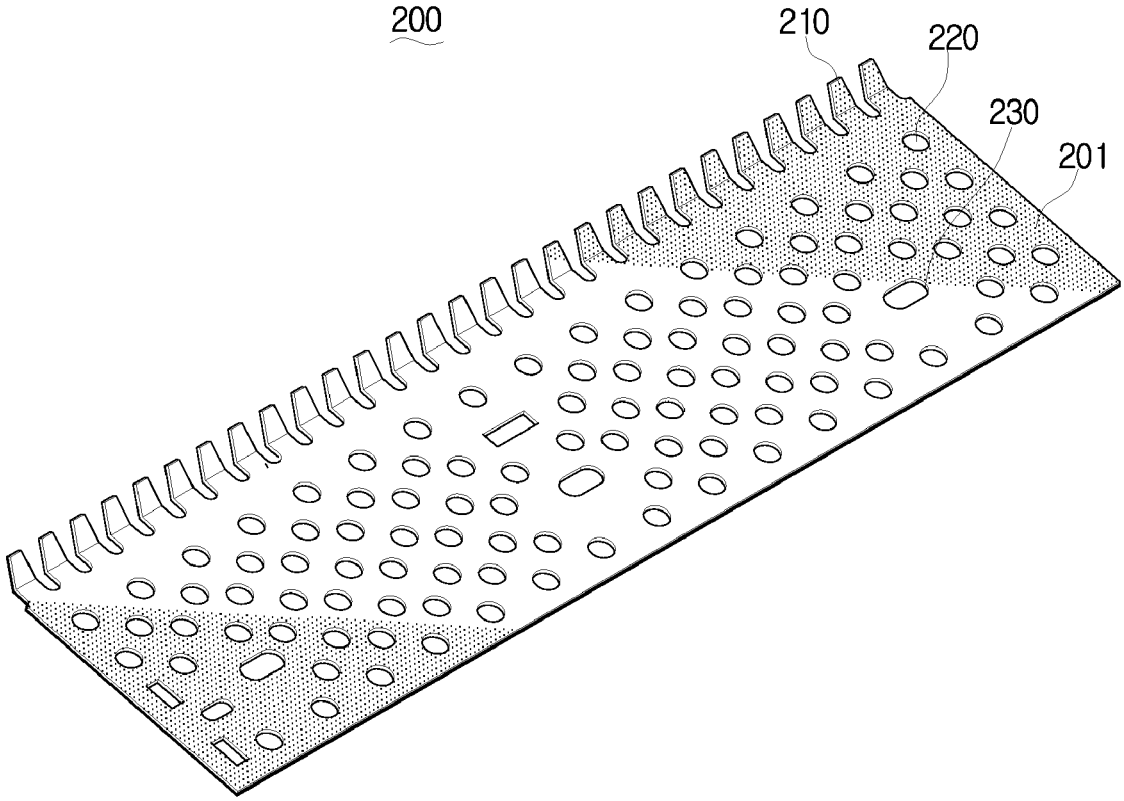
FIG. 2 is a perspective view illustrating a waste toner transfer unit according to an embodiment of the present general inventive concept.

The waste toner transfer unit 200, as shown in FIG. 2, is formed of a film having high elasticity and includes a plate 201, and a plurality of protrusions 210, passing holes 220 and guide slits 230.

Figure 4:
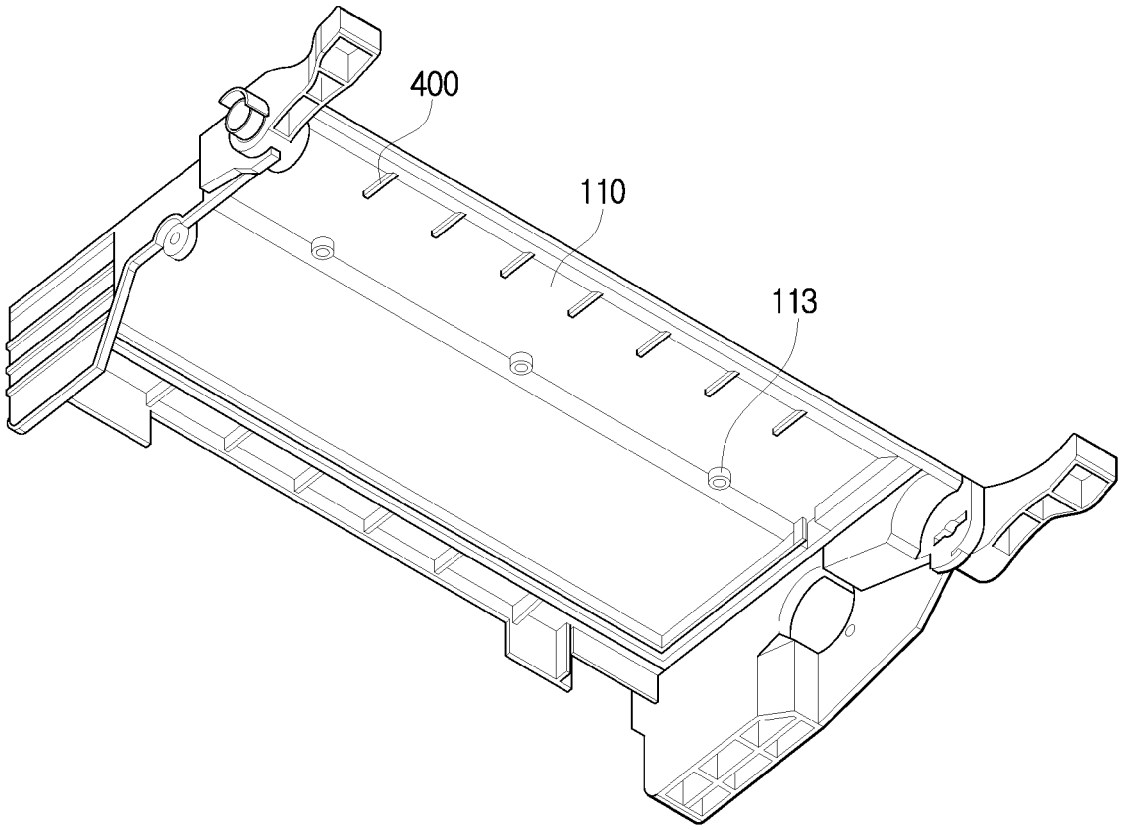
FIG. 4 is a perspective view illustrating an upper waste toner housing as shown in FIG. 1.
Figure 5:
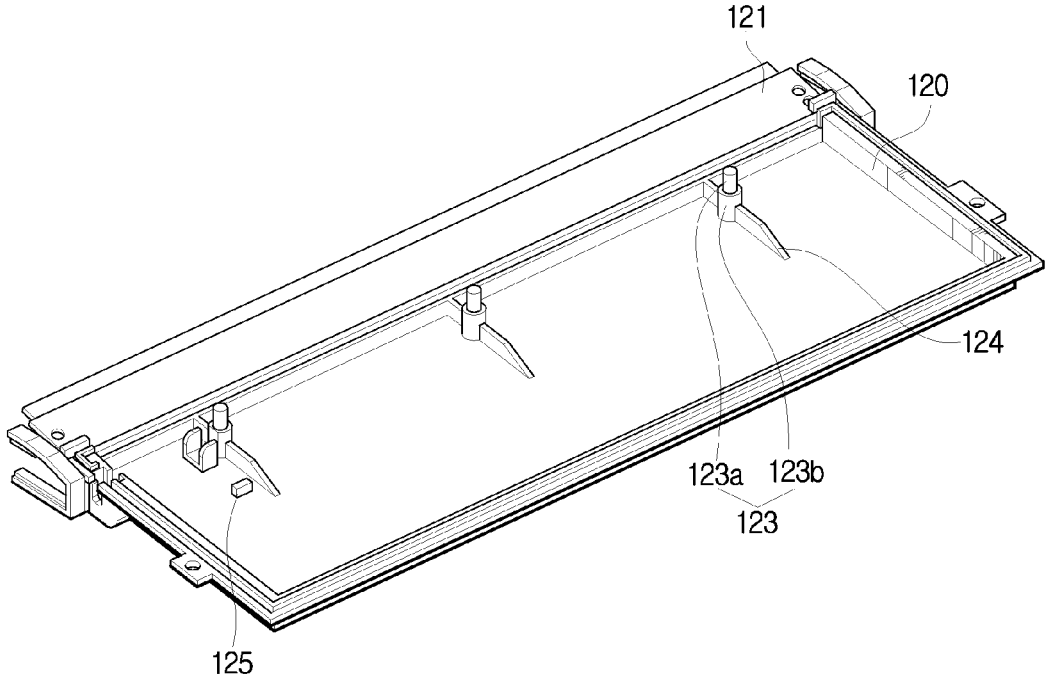
FIG. 5 is a perspective view illustrating a lower waste toner housing as shown in FIG. 1.

The plate 201 is disposed between the upper waste toner housing 110 (refer to FIG. 4) and the lower waste toner housing 120 (refer to FIG. 5) and is vibrated along a first direction of motion A where waste toner is transferred by a driving unit 300 which will be discussed below, so that waste toner scraped by the cleaning member 121 is transferred to the waste toner collecting portion 122.

Figure 3:
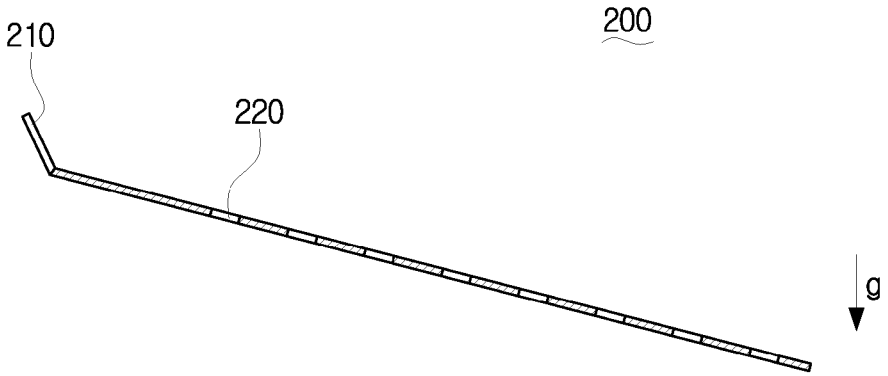
FIG. 3 illustrates a waste toner transfer unit as shown in FIG. 2, which is mounted in the inclined state.

As shown in FIG. 3, the waste toner transfer unit 200 inclines such that a first end that includes the protrusions 210 and faces, and is in close proximity to, the photoconductive medium 111 (refer to FIG. 1) may be disposed higher than an opposite and lower disposed second end.

Referring to FIG. 2, the plurality of protrusions 210 are prominently formed towards the photoconductive medium 111 of the waste toner transfer unit 200, to break up waste toner scraped by the cleaning member 121. The protrusions 210 may be bent upwards toward the upper waste toner housing 110.

The passing holes 220 prevent waste toner scraped by the cleaning member 121 from lumping together, that is, the passing holes 220 cause waste toner on the plate 201 to be broken up and substantially lump-free when the plate 201 vibrates along the first direction of motion A.

The guide slits 230 guide vibration of the plate 201 along the first direction of motion A. A plurality of first constraining members 113 (refer to FIG. 4), to engage with a plurality of second constraining members 123 (refer to FIG. 5), which are formed on the upper waste toner housing 110 and the lower waste toner housing 120, respectively, to pass through the guide slits 230.

According to an embodiment of the present general inventive concept, the first constraining members 113 are disposed on the upper waste toner housing 110, while the second constraining members 123 are disposed on the lower waste toner housing 120. However, these first and second constraining members 113 and 123 may be disposed vice-versa.

The first constraining member 113 may be formed in a boss-like configuration having penetrating openings to receive the second constraining member 123. The boss structures including the first constraining member 113 may have a diameter larger than the guide slits 230.

The first constraining member 113 and the second constraining member 123 fit together, at a clearance larger than the thickness of the waste toner transfer unit 200, so that the waste toner transfer unit 200 does not constrain the first constraining member 113 and the second constraining member 123.

The second constraining members 123 each includes first bosses 123*a* to pass through the guide slits 230, and second bosses 123*b* to support the waste toner transfer unit 200 from under the guide slits 230.

The first boss 123*a* has a diameter smaller than that of the guide slit 230, and the second boss 123*b* has a diameter larger than that of the guide slit 230. Accordingly, the second bosses 123*b* support the plate 201 from under the guide slits 230, and prevent the waste toner transfer unit 200 from falling.

Inclining ribs 124 (refer to FIG. 5) extend from the second bosses 123*b* to support the waste toner transfer unit 200 at an inclined position. Accordingly, the waste toner transfer unit 200 is inclined by the inclining ribs 124, with the waste toner transfer unit having the protrusions 210 at an upper side.

The driving unit 300 shakes the waste toner transfer unit 200 along the first direction of motion A. The driving unit 300 according to an embodiment of the present general inventive concept includes a delivery guide 310 and a driving cam 320, as shown in FIG. 1.

The delivery guide 310 is fixed on one end of the waste toner transfer unit 200, and a cam follower (not shown) is disposed at one side of the delivery guide 310. The delivery guide 310 is guided by a guide member 125 disposed on the bottom of the lower waste toner housing 120, that is, the delivery guide 310 is restrained in its back and forth movement by the guide member 125. A guide hole (not shown) to receive the guide member 125 is formed opposite to the side where the cam follower (not shown) is disposed. An elastic member may be disposed at the guide hole (not shown) to elastically support the delivery guide 310.

The driving cam 320 contacts the cam follower (not shown), and translates the rotary motion of driving cam 320 into the linearly reciprocative motion of the delivery guide 310 so that the waste toner transfer unit 200 linearly reciprocates on the cleaning member 121. The driving cam 320 includes a cam unit having an inclined plane. As the edge of the inclined plane is in contact with the cam follower, if the driving cam 320 rotates from a low point to a high point, the cam follower (not shown) is pushed forward. The stroke distance of the linearly reciprocative movement of the delivery guide 310 depends on the difference in height between the high point and the low point of driving cam 320.

The waste toner transfer unit 200 is vibrated along the first direction of motion A by the driving unit 300, preventing waste toner from forming lumps on the waste toner transfer unit 200. If the waste toner transfer unit 200 is vibrated along the first direction of motion A, the plurality of protrusions 210 constrain ribs 400, which will be explained below, and transfers the vibration to the waste toner transfer unit 200 along a second direction of motion B (refer to FIGS. 1 and 3) which is the gravity direction g, which is substantially perpendicular to the direction of motion A. The vibration along the second direction of motion B shakes off the waste toner of the waste toner transfer unit 200 into the waste toner collecting portion 122.

Figure 6:
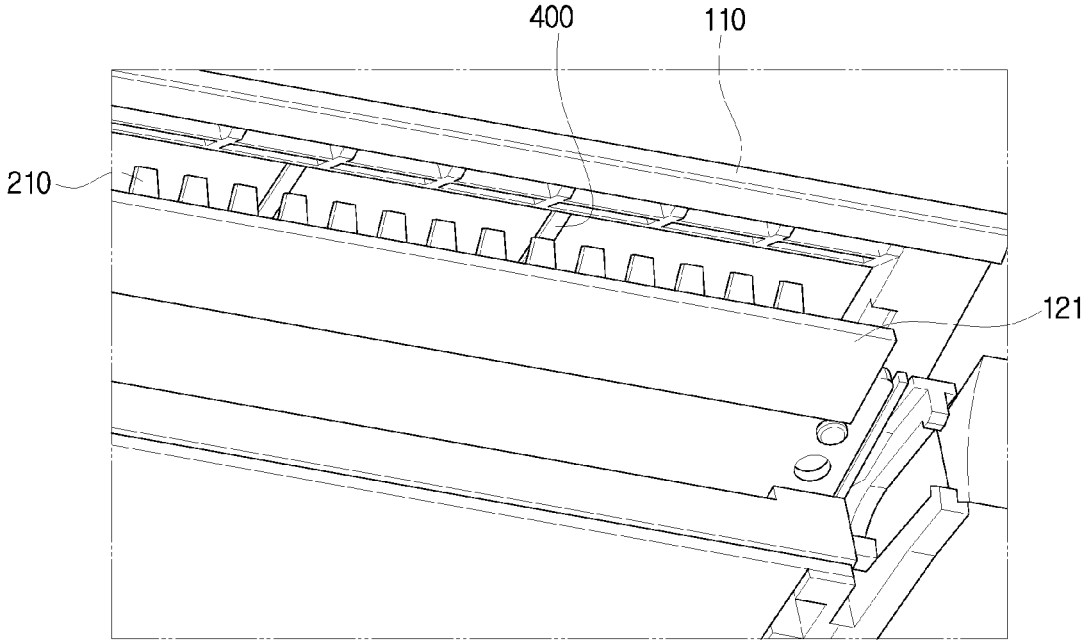
FIG. 6 is a bottom perspective view illustrating an upper waste toner housing as shown in FIG. 1, when viewed from inside.

The ribs 400 are disposed in the waste toner housing 100 to constrain the protrusions 210. According to an exemplary embodiment of the present general inventive concept, as shown in FIG. 6, the ribs 400 to project from an inner surface of the upper waste toner housing 110 so as to constrain the protrusions 210.

The number of the ribs 400 may be less than the number of the protrusions 210. If the number of the ribs 400 is too high, the ribs 400 carry a load to the driving unit 300 when the waste toner transfer unit 200 is vibrated along the first direction of motion A, resulting in malfunction and operation noise.

If the number of the ribs 400 is too low, it is difficult to vibrate the waste toner transfer unit 200 along the second direction of motion B. Therefore, it is preferable to have at least four ribs 400.

When the protrusions 210 and the ribs 400 are disposed to constrain each other, the protrusions 210, which are formed by curving a film of resin having superior elasticity, are elastically transformed (i.e., they bend) when interfering with the ribs 400, and are transformed back when not interfering the ribs 400.

Figure 7:
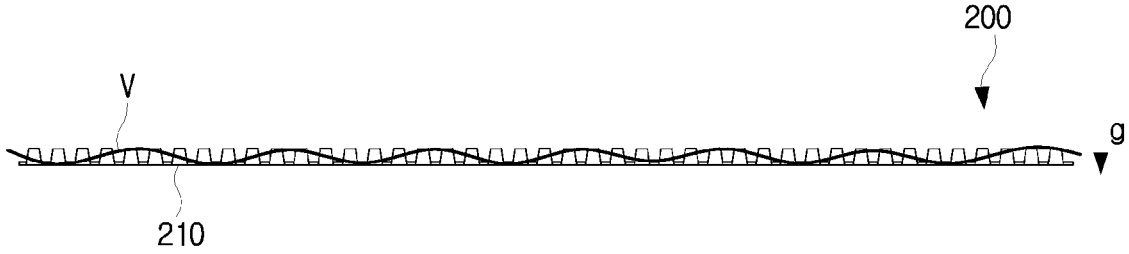
FIG. 7 is a front view schematically illustrating vertical vibrations represented by a waveform when a waste toner transfer unit, as shown in FIG. 3, moves right and left along a direction of motion.

Because such a movement is associated with high-speed right and left reciprocation of the waste toner transfer unit 200 along the first direction of motion A, vibration V represented by a sine waveform results and is transferred to the waste toner transfer unit 200 as shown in FIG. 7. The waste toner transfer unit 200 receiving the vibration V is also vibrated along the second direction of motion B as shown in FIG. 1 so that waste toner moving on the waste toner transfer unit 200 rapidly moves to the waste toner collecting portion 122 without lumping or congestion.

The operation of an image forming apparatus according to an exemplary embodiment of the present general inventive concept will be described below.

Figure 8:
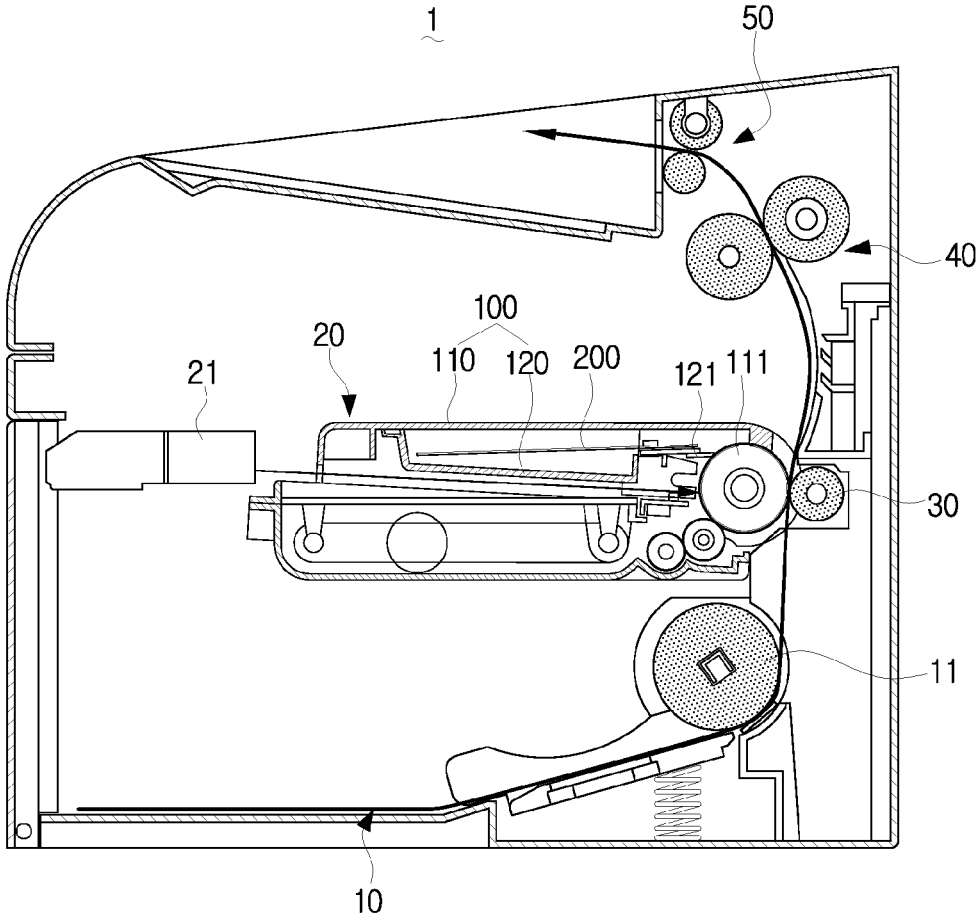
FIG. 8 schematically illustrates an image forming apparatus according to an embodiment of the present general inventive concept.

As shown in FIG. 8, the image forming apparatus 1 according to an exemplary embodiment of the present general inventive concept includes a feeding unit 10, a developing unit 20, a transfer unit 30, a fixing unit 40, and a discharge unit 50.

When a printing operation starts, sheets of paper stacked on the feeding unit 10 are transmitted to the developing unit 20 by a pickup unit 11. A laser scanning unit 21 forms print image information with a laser beam, the laser beam is imaged to form an electrostatic latent image on the surface of a photoconductive medium 111. The developing unit 20 forms a toner image by attaching toner on the electrostatic latent image, and the photoconductive medium 111 transfers the toner image onto printing paper by engaging and rotating the transfer unit 30. The printing paper receiving the toner image receives heat and pressure from the fixing unit 40 so that the toner image is affixed to the printing paper. Therefore, printing is completed. The printing paper containing the toner image is discharged outside the image forming apparatus through the discharge unit 50.

Waste toner which is not transferred to the printing paper is removed by the cleaning member 121.

Waste toner removed by the cleaning member 121 is first broken up by the plurality of protrusions 210, which can be bent upwards, of the waste toner transfer unit 200. The waste toner transfer unit 200 is downward inclined toward the waste toner collecting portion 122 and reciprocates along the first direction of motion A, which is parallel with an axial direction of the photoconductive medium 111, by operation of the driving unit 300. Accordingly, waste toner moving on the waste toner transfer unit 200 is secondly broken up by the right and left reciprocative movement of the waste toner transfer unit 200, and is transmitted to the waste toner collecting portion 122.

When the waste toner transfer unit 200 reciprocates along the first direction of motion A, the plurality of protrusions 210, which can be bent upwards, constrain the ribs 400 in the upper waste toner housing 110. Accordingly, as shown in FIG. 7, vibration wave form V, which is similar to the sine waveform representing motion in the gravity direction g, is transferred to the waste toner transfer unit 200. The vibration waveform V causes waste toner moving along the waste toner transfer unit 200 to be shaken off to the waste toner collecting portion 122, so that waste toner moving on the waste toner transfer unit 200 is not lumped or accumulated, but instead is rapidly moved.

Thus, to sum up, the waste toner transfer unit 200 may be vibrated along the second direction of motion B, the gravity direction g, in association with the reciprocative movement along the first direction of motion A by the driving unit 300. Accordingly, waste toner scraped by the cleaning member 121 is not lumped and is uniformly spread due to the reciprocative movement along the first direction of motion A, and is not accumulated on the waste toner transfer unit 200 due to the vibration along the second direction of motion B. As a result, the overflow of waste toner to the cleaning member 121, because of the accumulation of waste toner, can be prevented and deterioration of cleaning performance can be improved.

Furthermore, because the waste toner transfer unit 200 moves in two substantially perpendicular directions of motion, such as right and left, and up and down, accumulation of waste toner and solidification (lumping) of toner caused in the case of one way movement along only one direction of motion, such as right and left is prevented, so that the overflow of waste toner to the cleaning member 121, in spite of sufficient space of the waste toner collecting portion 122, can be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

As described above, waste toner can be rapidly moved to the waste toner collecting portion. Accordingly, although waste toner is generated in high amounts, removed waste toner cannot flow back to the cleaning member.

As described above, deterioration of cleaning performance due to accumulation of waste toner can be improved by preventing waste toner from lumping or being accumulated on the cleaning member.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A waste toner transfer device, comprising:

a waste toner transfer unit which is disposed in proximity to a cleaning member to transfer waste toner removed from a rotatable photoconductive medium by the cleaning member, and includes a plurality of protrusions at one end;

a driving unit to reciprocate the waste toner transfer unit along a first direction of motion; and a vibration generating unit to vibrate the waste toner transfer unit along a second direction of motion when the waste toner transfer unit moves along the first direction of motion;

wherein the vibration generating unit comprises a plurality of ribs to constrain the plurality of protrusions when the waste toner transfer unit moves in the first direction of motion.

2. The waste toner transfer device of claim 1, wherein the plurality of protrusions are bent at a first end of the waste toner transfer unit to face the photoconductive medium.

3. The waste toner transfer device of claim 1, wherein the waste toner transfer unit comprises a plurality of passing holes; and a guide slit to guide the waste toner transfer unit in rightward or leftward directions along the first direction of motion.

4. The waste toner transfer device of claim 1, wherein the waste toner transfer unit is formed of an elastic material.

5. The waste toner transfer device of claim 1, wherein the plurality of ribs are disposed on a waste toner housing to support the photoconductive medium.

6. The waste toner transfer device of claim 1, wherein the driving unit includes a delivery guide which is fixed at one end of the waste toner transfer unit and includes a cam follower; and a driving cam which has an inclined surface corresponding to the cam follower of the delivery guide.

7. The waste toner transfer device of claim 1, wherein the waste toner transfer unit is inclined downwards from a part of the waste toner transfer unit in close proximity to the photoconductive medium to a part opposite the photoconductive medium.

8. The waste toner transfer device of claim 5, wherein the waste toner housing includes an upper waste toner housing and a lower waste toner housing, and the waste toner transfer unit is interposed between a first constraining member and a second constraining member which are complementarily disposed on the upper waste toner housing and the lower waste toner housing, respectively.

9. The waste toner transfer device of claim 8, wherein the first constraining member is formed on the upper waste toner housing and the second constraining member is formed on the lower waste toner housing.

10. The waste toner transfer device of claim 9, wherein the second constraining member includes a first boss which passes through a guide slit in the waste toner transfer unit; and a second boss to support the waste toner transfer unit under the guide slit.

11. The waste toner transfer device of claim 10, wherein the first boss has a diameter smaller than the guide slit, and the second boss has a diameter larger than the guide slit.

12. The waste toner transfer device of claim 11, wherein the second boss includes a inclining rib to inclinedly support the waste toner transfer unit.

13. A waste toner cleaning device, comprising:

a cleaning member which removes waste toner from a photoconductive medium;

a waste toner transfer unit which is disposed on a waste toner transfer surface of the cleaning member to receive the waste toner removed from the photoconductive medium by the cleaning member and to transfer the waste toner, and includes a plurality of protrusions at one end;

a driving unit to reciprocate the waste toner transfer unit along a first direction of motion;

a vibration generating unit to vibrate the waste toner transfer unit along a second direction of motion when the waste toner transfer unit moves along the first direction of motion; and a waste toner housing to store the waste toner transferred by the waste toner transfer unit;

wherein the vibration generating unit includes a plurality of ribs to constrain the plurality of protrusions when the waste toner transfer unit moves along the first direction of motion.

14. The waste toner cleaning device of claim 13, wherein the plurality of protrusions are bent to face the photoconductive medium.

15. The waste toner cleaning device of claim 13, wherein the waste toner transfer unit includes a plurality of passing holes.

16. The waste toner cleaning device of claim 13, wherein the waste toner transfer unit is formed of an elastic material.

17. The waste toner cleaning device of claim 13, wherein the plurality of ribs are disposed on a waste toner housing.

18. The waste toner cleaning device of claim 13, wherein the driving unit includes a delivery guide which is fixed at one end of the waste toner transfer unit and includes a cam follower; and a driving cam which has an inclined surface corresponding to the cam follower of the delivery guide.

19. An image forming apparatus, comprising:

a photoconductive medium which is rotatably disposed in a housing to form an electrostatic latent image;

a developing unit to develop the formed electrostatic latent image; and a waste toner cleaning device to remove waste toner from the photoconductive medium after the image is formed, wherein the waste toner cleaning device comprises:

a cleaning member which faces the photoconductive medium to remove waste toner from the photoconductive medium;

a waste toner transfer unit which is disposed on a waste toner transfer surface of the cleaning member to receive the waste toner removed from the photoconductive medium by the cleaning member and to transfer the waste toner, and includes a plurality of protrusions at one end;

a driving unit to reciprocate the waste toner transfer unit along a first direction of motion;

a vibration generating unit to vibrate the waste toner transfer unit along a second direction of motion when the waste toner transfer unit moves along the first direction of motion; and a waste toner housing to store the waste toner transferred by the waste toner transfer unit;

wherein the vibration generating unit includes a plurality of ribs to constrain the plurality of protrusions when the waste toner transfer unit moves in the first direction.

20. The image forming apparatus of claim 19, wherein the plurality of protrusions are bent toward the end facing the photoconductive medium.

21. The image forming apparatus of claim 19, wherein the waste toner transfer unit includes a plurality of passing holes.

22. The image forming apparatus of claim 19, wherein the waste toner transfer unit is formed of an elastic material.

23. The image forming apparatus of claim 19, wherein the plurality of ribs are disposed on a waste toner housing.

24. The image forming apparatus of claim 19, wherein the driving unit includes a delivery guide which is fixed at one end of the waste toner transfer unit and includes a cam follower; and a driving cam which has an inclined surface corresponding to the cam follower of the delivery guide.

25. An image forming apparatus, comprising:

a photoconductive medium to form an electrostatic latent image;

a developing unit to develop the formed electrostatic latent image of the photoconductive medium using toner;

a transfer unit to transfer the developed image of the photoconductive medium onto printing paper; and a waste toner cleaning device to remove waste toner from the photoconductive medium, wherein the waste toner cleaning device comprises:

a cleaning member of which one end contacts the photoconductive medium;

a waste toner transfer unit which is disposed above and in proximity to the cleaning member to receive the waste toner removed from the photoconductive medium by the cleaning member and to transfer the waste toner, and the waste toner transfer unit vibrates horizontally and vertically; and a waste toner housing to store the waste toner transferred by the waste toner transfer unit;

wherein the waste toner transfer unit includes a plurality of protrusions which are bent upwards at one end of the waste toner transfer unit to face the photoconductive medium; and a plurality of ribs are disposed at a location of the waste toner housing facing the protrusions so that the waste toner transfer unit vibrates upward and downward by interference between the protrusions and the ribs.

26. A waste toner transfer unit of an image forming apparatus, the waste toner transfer unit comprising:

a plate which is disposed to be movable vertically and horizontally inside a waste toner housing in order to break up and transfer waste toner removed from a surface of a photoconductive medium; and a plurality of protrusions which are bent upwards at one end of the plate to face the photoconductive medium, and to constrain at least one rib on the waste toner housing when the plate moves horizontally, so that the plate moves vertically.

* * * * *